United States Patent [19]

Gaccetta et al.

[11] Patent Number: 4,491,222

[45] Date of Patent: Jan. 1, 1985

[54] REEL PACKAGE

[75] Inventors: Carl M. Gaccetta, Denver; Terry J. Lutz, Boulder County, both of Colo.

[73] Assignee: International Business Machines Corporation, Armonk, N.Y.

[21] Appl. No.: 514,998

[22] Filed: Jul. 18, 1983

[51] Int. Cl.[3] ..... B65D 85/66; B65D 85/671

[52] U.S. Cl. ..... 206/394; 206/413; 206/497

[58] Field of Search ..... 206/394, 413, 395, 410, 206/497

[56] References Cited

U.S. PATENT DOCUMENTS

| | | | |
|---|---|---|---|
| 2,912,102 | 11/1959 | Scott | 206/394 |
| 2,929,496 | 3/1960 | Muehlebach et al. | 206/394 |
| 3,371,776 | 3/1968 | Voissem | 206/394 |
| 3,371,882 | 3/1968 | Orlando et al. | 242/55.13 |
| 3,620,478 | 11/1971 | Fitzgerald et al. | 242/197 |
| 3,640,049 | 2/1972 | Fritz et al. | 206/394 |
| 3,735,862 | 5/1973 | Nimmo, Jr. | 206/394 |
| 3,768,641 | 10/1973 | Jerzenski, Jr. | 206/394 |
| 3,987,897 | 10/1976 | Smith | 206/394 |
| 4,062,447 | 12/1977 | Gardner | 206/396 |
| 4,069,914 | 1/1978 | Damsky | 206/394 |
| 4,122,945 | 10/1978 | Borzak | 206/395 |
| 4,282,973 | 8/1981 | Binkowski | 206/444 |

*Primary Examiner*—Joseph Man-Fu Moy
*Attorney, Agent, or Firm*—Francis A. Sirr

[57] ABSTRACT

A packaging system for 10½-inch magnetic tape reels in which ten such reels are axially stacked and separated by stacking rings. This axially stacked assembly is then stretch-wrapped in a manner which produces substantial overlap of the stretch-wrap material. A support panel assembly, and two mounting plugs, capture the reels and the wrap material, to thereby seal the reels, and also support the reels with the edges thereof protected. An overpack box conforms to the shape of the support panel assembly, to further support and protect the reels, with the reel edges out of contact with the inner surface of the overpack box.

11 Claims, 8 Drawing Figures

REEL PACKAGE

DESCRIPTION

1. Technical Field

This invention pertains to the packing, shipment and storage of a plurality of magnetic tape reels which have been formed into a multi-reel unitary assembly.

2. Background of the Invention

The present invention will be described in the environment of the well known 10½ inch diameter, one-half inch wide, magnetic tape reel frequently used in computer rooms. However, the present invention is not limited to this specific reel.

Magnetic tape reels are shipped, from the manufacturer to the user, in boxes which contain a number of reels. An assembly of ten such reels, weighing about twenty-five pounds, has been found to be convenient.

These reels can comprise only tape-filled reels, or the tape-filled reels may be equipped with protective covers, two of which are shown in U.S. Pat. Nos. 3,371,882 and 3,620,478, incorporated herein by reference. The present invention is usable with any of these reels.

A number of reel packages exist in the prior art. U.S. Pat. Nos. 4,062,447 and 4,122,945 are exemplary. In U.S. Pat. No. 4,062,447, a loose assembly of reels are separated by individual square retainer pads (20). Each pad includes a pair of foldable reel retaining elements (26) which, when folded, extend into the reel's centrally located drive-mounting hub. In this manner, the pads are intended to hold the reels away from the boundary edges of the retainer pads. An outer box (12) conforms to the square shape of the pads, and in this manner the reel edges are intended to be held out of contact with the inside surface of the box.

This relatively loose assembly, whereby heavy reels of tape are supported by folded elements, may still subject the reels to edge damage, when the box is subjected to drop tests and the like.

Other arrangements are known where two reels are axially stacked, and then firmly mounted to a flat, square separator, using plastic sheeting and vacuum forming techniques. Again, these separators are larger than the reel diameter. A plurality, for example five, of these two-reel, unitary assemblies are then packed into a square cross-sectional box. While this arrangement holds the reel edges from the box's interior surface, it provides what can be characterized as a loose assembly of parts, whose manufacturing cost is affected by the fact that five separate packaging operations (of two reels each) are necessary.

In U.S. Pat. No. 4,282,973 a stack of floppy disks are packaged for shipment by placing them in a heat shrinkable plastic bag, which bag, after heat shrinking, is placed into a protective foam collar.

SUMMARY OF THE INVENTION

The present invention provides a package of N (filled) tape reels (N=10) in which the reels are axially stacked and spaced by N−1 (plastic) separator rings which enable placement of the reels into an axially stacked configuration. This stack of reels is then stretch wrapped, preferably by means of a web of stretch-wrap material whose width is substantially longer than the axial length of the stacked reels. During stretch wrapping, the border edges of the stretch-wrap material overlap and deform onto the flanges of the two end reels, thus providing an axial force, forcing the stacked reels tightly together, into a first unitary assembly. When the border edges of the wrap material are stuffed into the hub mounting openings of the two end reels, the assembly is, for all practical purposes, sealed from the environment.

This first unitary assembly is then placed in a U-shaped (corrugated board) holding member. This holding member has a base plate equal in length to the axial length of the first unitary assembly, i.e., the stacked and wrapped reel assembly. Also, this holding member includes a pair of parallel, spaced-apart, square support members, each having a centrally located opening similar in size and shape to the reel drive-mounting openings.

The openings in these square support members are spaced from the edges of these square panels by a distance which is greater than the radius of a reel.

Mounting plugs are inserted through these openings, and into the drive-mounting openings of the end reels in the first unitary assembly. In this operation, the border areas of the wrap material are captured, thus sealing the package.

A second unitary assembly has now been formed. This second unitary assembly is then placed in a square cross-sectional outer box which protects the reels, with the reel flanges out of engagement with the inside surface of the box.

The foregoing and other features and advantages of the invention will be apparent from the following more particular description of preferred embodiments of the invention, as illustrated in the accompanying drawing.

THE INVENTION

Figure 1:
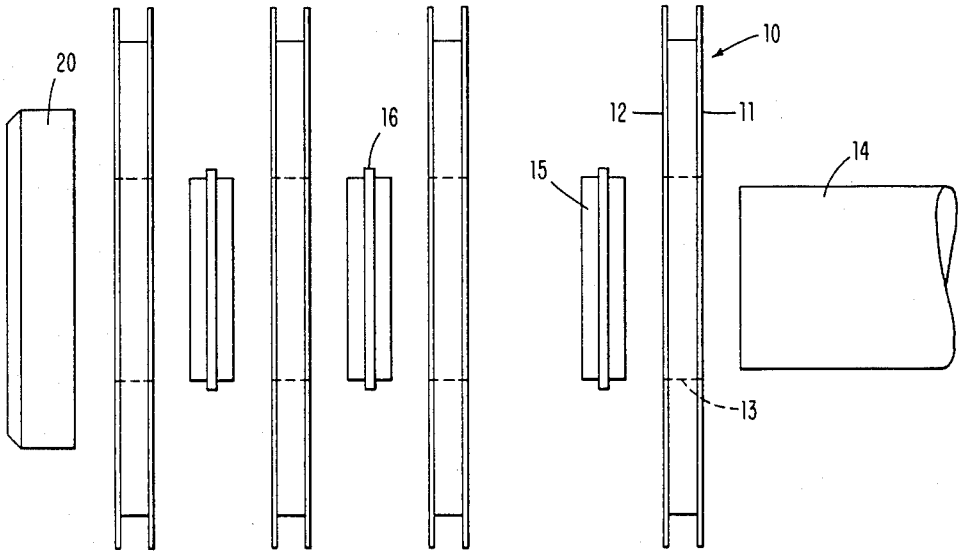
FIG. 1 shows a number of tape reels and separator rings in exploded view relative a mandrel and the mandrel's chuck, which mandrel and chuck hold the rings during stretch wrapping.
Figure 4:
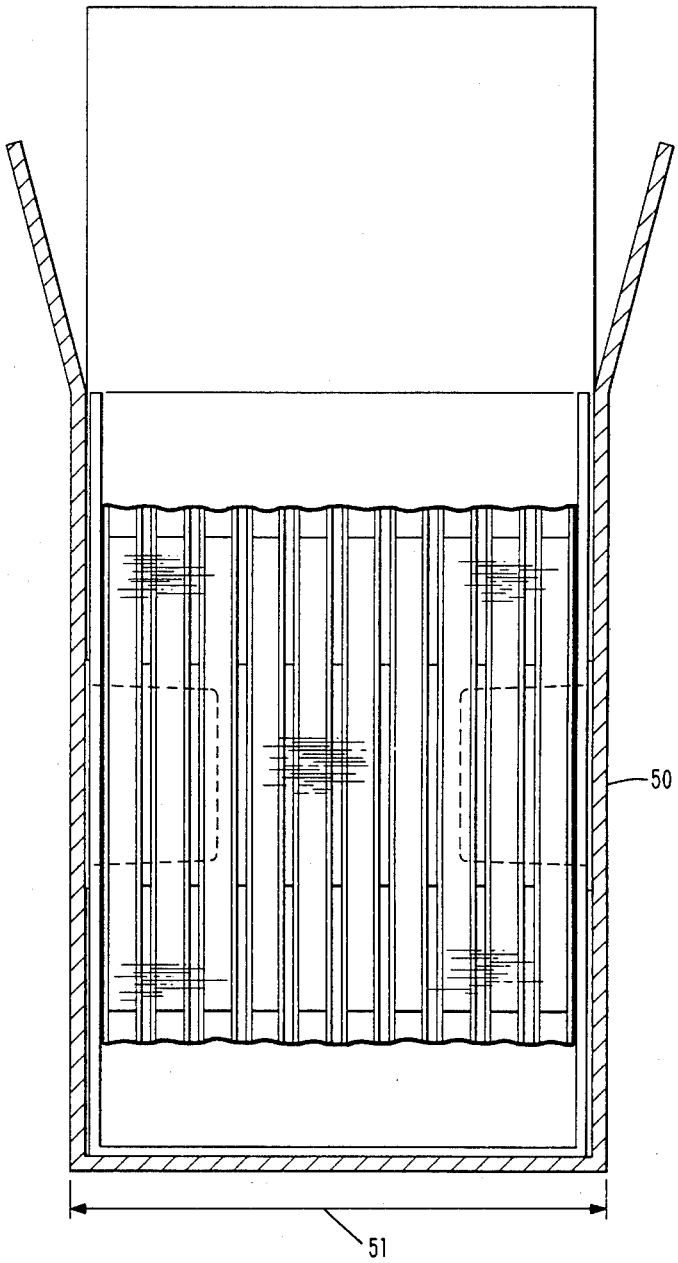
FIG. 4 shows the FIG. 3 unitary assembly positioned within the outer box, whose front panel has been cut away to show how the edges of the reel flanges are spaced from the bottom, top and two long sides of the outer box by the distance "d"
Figure 5:
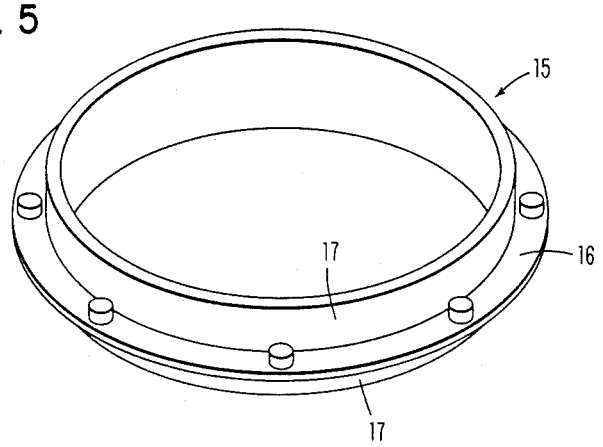
FIG. 5 is an enlarged view of one of the separator rings.

As stated, the industry has found it convenient to package ten 10½ inch reels 10 (FIG. 1) of one-half inch wide magnetic tape into a single package, for storage and/or shipment. The details of construction of such a reel will not be described, since they are well known to those of skill in the art. It is sufficient to say that each reel includes two 10½ inch diameter circular flanges 11 and 12 which are attached to a centrally located, hollow drive hub, about 3½ inches in diameter. The reels of FIG. 1 do not include the aforesaid protective covers, but they could include such covers, if desired, since the spacing "d" of FIG. 3 (to be described) will accommodate the added space occupied by the covers, without bringing the covers into contact with the inner surface of FIG. 4's outer box. In FIG. 1, ten such reels are placed on circular cylinder, rotatable mandrel 14, whose outer diameter is somewhat less than the inner diameter of the reels' mounting openings 13. The flanges of adjacent reels do not physically engage. Rather, adjacent reels are separated by a separator or stacking ring 15 (FIG. 5). As shown, each stacking ring (nine total) is a unitary plastic piece (for example, polyethylene) including a flat spacing ring 16 which extends parallel to and spaces adjacent reel flanges. Each separator ring also includes two extending, hollow, circular-cylinder bosses 17 whose outer diameter snugly fits within the reels' mounting opening, and whose inner diameter snugly fits over mandrel 14 (FIG. 1). In this manner, ten reels and nine separator rings can be stacked on mandrel 14. This reel/separator ring assembly is then axially compressed by the use of a vacuum chuck 20 which cooperates with the exposed left-hand end of mandrel 14, forcing the right-most reel against a right-hand mandrel flange (not shown).

While FIG. 1 shows mandrel 14 extending in a horizontal direction, such is not essential. A variety of stretch wrap machines are commercially available, and mandrel 14 can extend in any direction, to accommodate whatever stretch wrap machine is selected.

In addition, the specifications of the stretch wrap material per se are not critical to the present invention. We prefer linear low density polyethylene, about 0.001 inch thick, and at least twenty inches wide, as compared to the axial stacked length of about nine inches for ten reels and nine separator rings. We also prefer that the stretch wrap machine (not shown) be one which prestretches the material before wrapping the ten-reel assembly. We have found it preferable to wrap the ten-reel assembly with one wrap at no tension, followed by two to four additional wraps with the stretch wrap material prestretched to about 120% of its original length. The direction of wrap is circumferentially about the reel flanges 11, 12, and about the central rotational axis of mandrel 14.

As those skilled in the art of stretch wrapping will appreciate, a variety of means, such as adhesive tape, can be provided to attach the leading inner edge of the wrap material to the stack of reels, prior to beginning the wrapping process. We prefer the use of foam rubber plugs which are inserted between the reel flanges of the two end reels in the stack, to thereby trap the wrap material's leading edge between these flanges.

Figure 2:
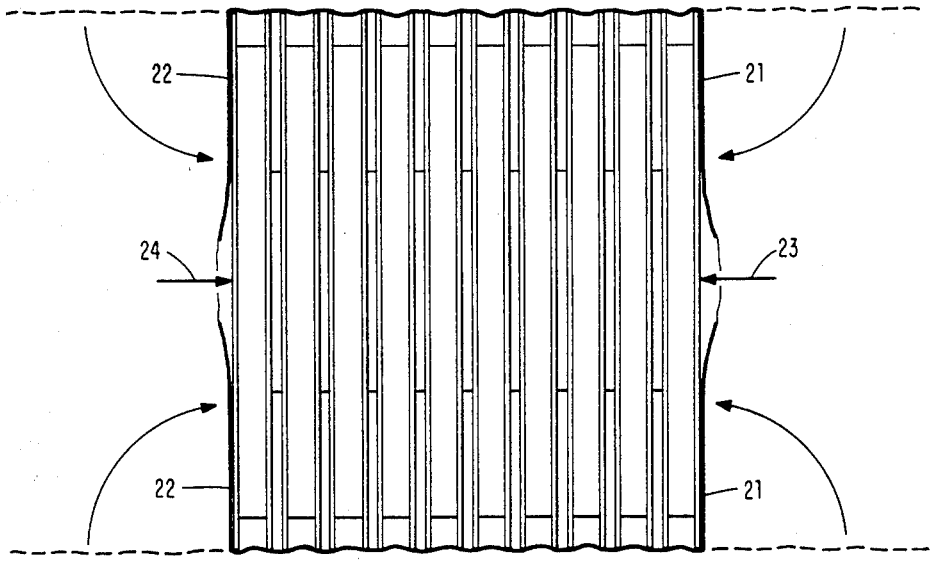
FIG. 2 shows the first unitary assembly of N reels (N=10) and N−1 separator rings which result from stretch wrapping, and additionally shows how the tension within the stretch wrap material causes this material to overlap the outer flanges of the end reels, producing an axial force (shown by the two arrows) which forms a solid unitary assembly of N reels, with the border portions of the stretch wrap material extending to the outer reels' centrally located mounting hub.

After stretch wrapping the mandrel's ten-reel assembly, as aforesaid, chuck 20 is removed, and the first unitary assembly of FIG. 2 is removed from mandrel 14.

This unitary assembly includes annular portions 21 and 22 of stretch wrap material which, by virtue of the well known stretch wrap phenomena, firmly press against the outer reel flanges of the two end reels, forcing the ten reels and nine separator rings into a solid, one-piece package. Arrows 23 and 24 have been provided in FIG. 2 to depict the force effect produced by annular portions 21 and 22 of the stretch wrap material.

It is also important to note in FIG. 2 that the border, loose portions of the stretch wrap material extend to, and overlap, the centrally located mounting openings in the end reels of this first unitary assembly.

This first unitary assembly is a stable, single block of tightly fitted parts; and as such it can be transported, but with care being taken to insure that the reel flanges are not damaged.

Figure 3:
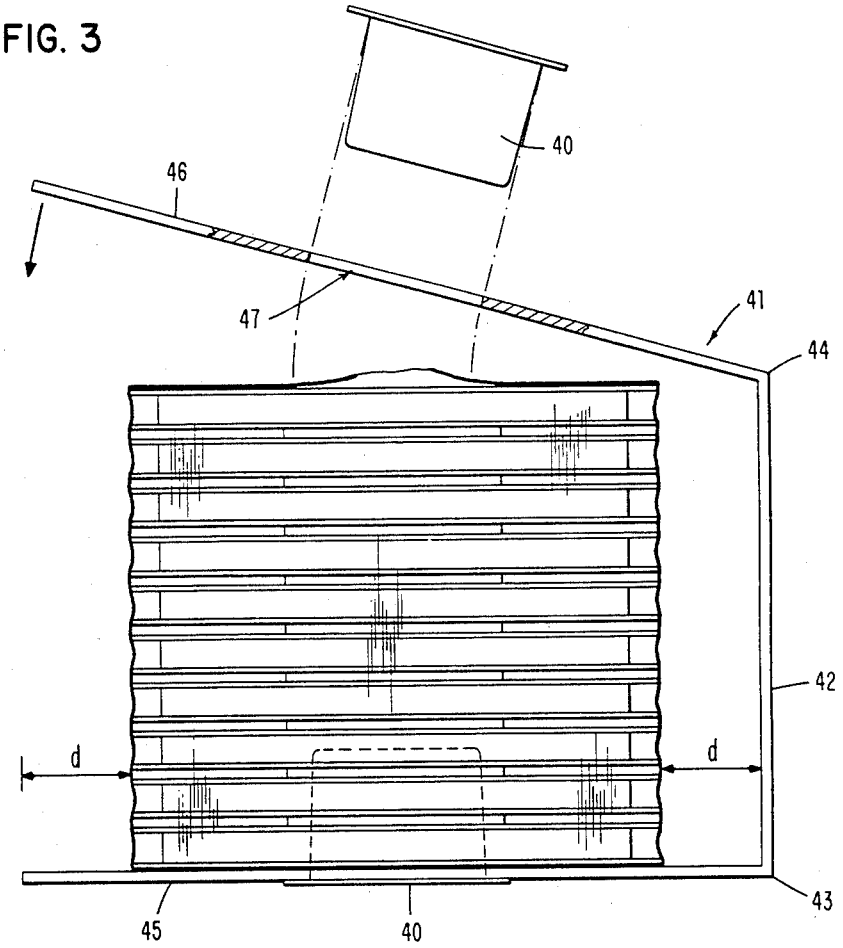
FIG. 3 shows the FIG. 2 assembly placed within the U-shaped holding member, with the bottom mounting plug inserted through the opening in one square support member, and with the top mounting plug ready to be inserted in the opening of the other square support member, to thus capture the border portions of the stretch wrap material, sealing the reels and forming a second unitary assembly.

A second unitary assembly is now formed, as shown in FIG. 3. This second assembly adds two mounting plugs 40 (also see FIG. 6), and a U-shaped holding member 41, to the first unitary assembly.

Member 41 can be of any strong, rigid material. We prefer either 275-pound strength, double-wall corrugated paperboard; or 350-pound strength, single-wall corrugated paperboard.

Member 41 comprises a base panel 42, about 9×14 inches, wherein the nine-inch length is measured in the direction of axial reel stacking. Base panel 42 is connected, as by fold-scores 43 and 44, to a pair of upstanding, spaced-apart, square support members 45 and 46. These members are about 14 inches square, and each includes a centrally located opening 47, about 3½ inches in diameter. Top member 46 is broken away to show its opening 47. Bottom member 45 has been coupled to the bottom reel in the stack, using one of the two mounting plugs 40. In so doing, plug 40 acts to stuff the border portions of the stretch wrap material (FIG. 2) into this reel's mounting opening, thus sealing this end of the stack.

Figure 6:
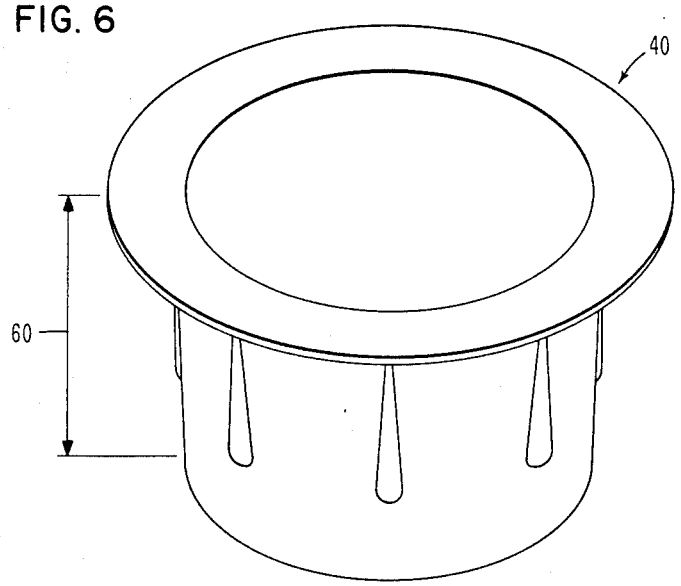
FIG. 6 is an enlarged view of one of the mounting plugs.

As seen in FIG. 6, each mounting plug 40 is a continuous cup of material, so as to form a seal. While plugs 40 may be made of any strong, rigid material, we prefer using injection molded polypropylene, about 0.060 inch thick. We have found it desirable that the dimension 60 of each plug be such that the plug penetrates at least the two end stacking rings, at each end of the stack.

The top end of FIG. 3's stack is mounted to support member 46 by the use of its mounting plug 40. Again, this plug captures the border ends of the stretch wrap material, and wedges or stuffs the same into the mounting opening of the top reel.

A second unitary assembly has now been formed. In this assembly, the flange edges of the reels are protected by a distance "d", by which portions of U-shaped holding member 41 extend beyond the reel edges.

This second unitary assembly is also a stable, single block of tightly fitted parts; and as such, it can be transported. While the reels are somewhat protected, care must still be exercised. To aid in the handling of this second unitary assembly, we have found it advantageous to add hand-holes (not shown) in the left-hand portions of panels 45 and 46 (FIG. 3). These hand-holes are particularly useful for handling this second unitary assembly.

While the aforementioned second unitary assembly has utility in most types of transport and storage, shipment to remote locations may require more protection. This is provided by the conventional fiberboard box 50 shown in FIG. 4. Box 50 is about nine inches long (dimension 51), and is about 14×14 inches in cross section. In this way, the aforesaid second unitary assembly tightly fits within box 50. The four upper cover flaps of box 50 are then closed, and the box is sealed. The stacked reel assembly is now protected from all but the most severe impact.

Figure 7:
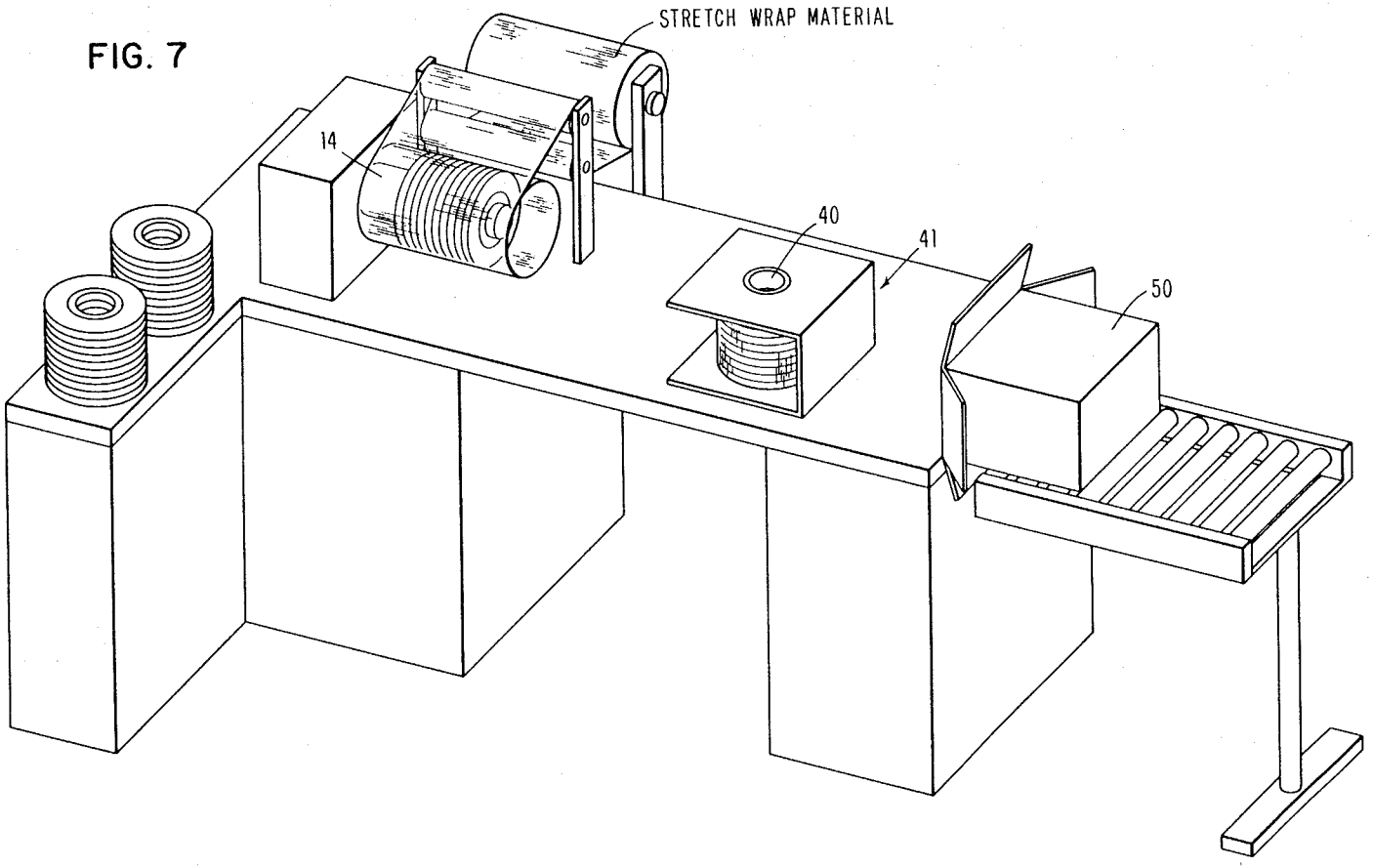
FIG. 7 shows an exemplary process where the stack of reels are supported by a horizontal mandrel during stretch wrapping.

FIG. 7 shows the.preferred means for wrapping a horizontal stack of reels, while these reels are supported by mandrel 14.

Figure 8:
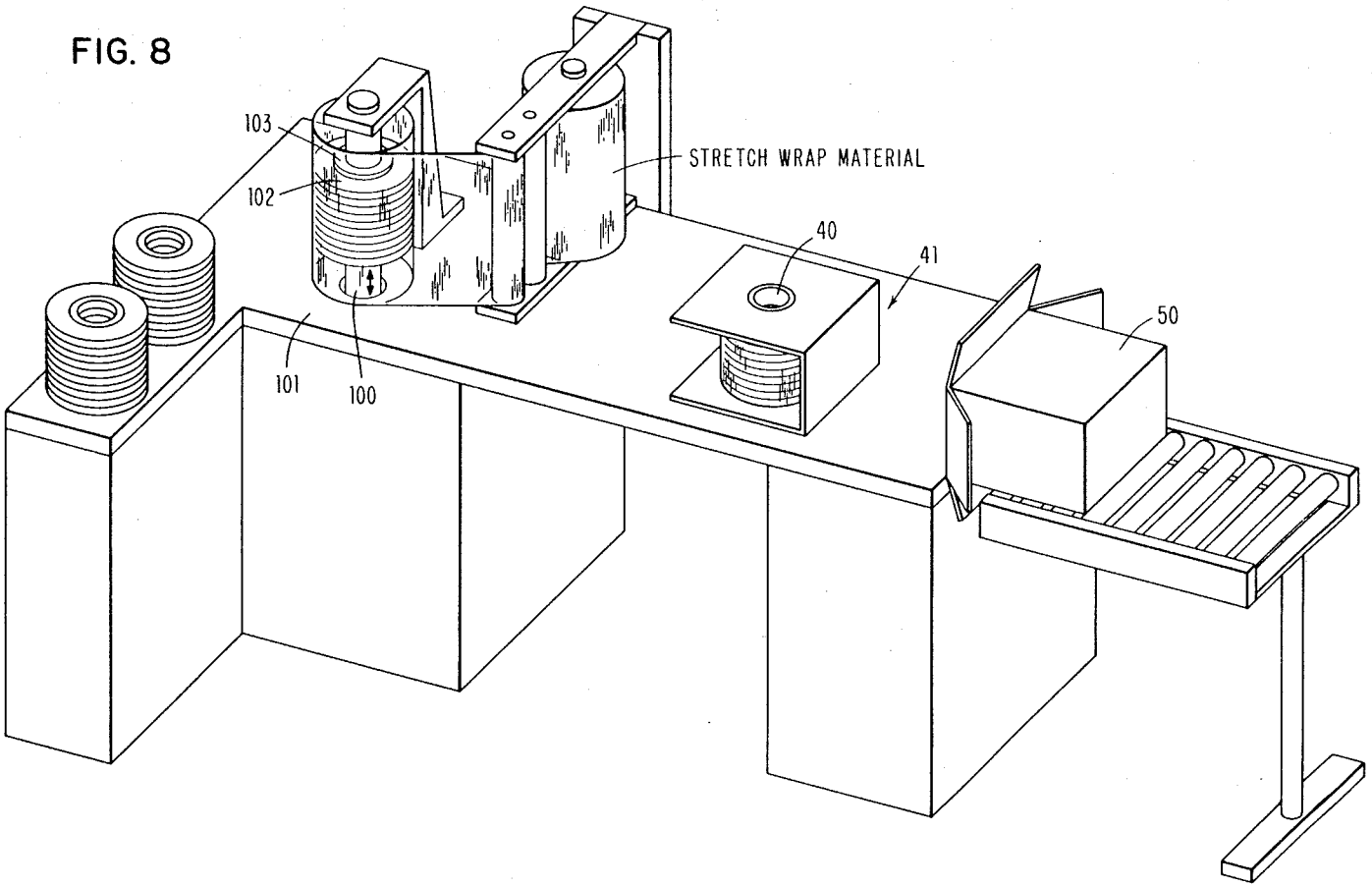
FIG. 8 shows an exemplary process where the stack of reels is vertically oriented during stretch wrapping.

FIG. 8 shows the preferred means for wrapping a vertical stack of reels. Here, a mandrel 14 (FIGS. 1 and 7) is not used. Rather, a lower driven spindle 100 is initially lowered so that the reels can be stacked on table 101. Thereafter, the stack of ten reels is elevated by spindle 100, so that the top reel 102 engages a stationary, but freely rotatable top spindle 103. In this manner, the stack of reels is compressed between spindles 100 and 103, as shown in FIG. 8. The end of the stretch wrap material is now attached to the stack of reels, and the reels are wrapped, as aforesaid, by rotationally driving spindle 100. Spindle 100 is then lowered.

While the invention has been particularly shown and described with reference to preferred embodiments thereof, it will be understood by those skilled in the art that various changes in form and details may be made therein without departing from the spirit and scope of the invention.

What is claimed is:

1. A magnetic tape reel package, comprising:

a plurality (N) of magnetic tape reels, each having a pair of spaced, flat, disk-shaped flanges which are joined together at a central hub; said hub having a drive-mounting opening for use in mounting the reel to a tape-using device; and a length of magnetic tape wound about said hub and occupying the space between said flanges; a plurality (N−1) of single piece stacking rings, one of which is positioned between each of said reels, each of said stacking rings including a flat spacing ring, extending parallel to said reel flanges, and operable to space the flanges of adjacent reels, each of said stacking rings also having two hollow bosses extending from opposite sides of said spacing ring and snugly fitted into the mounting opening of adjacent reels; to thereby form a first unitary assembly of N axially-aligned reels;

a length of stretch-wrap material wound axially about said first unitary assembly, to form a second unitary assembly; said stretch-wrap material being of a width such that the opposite axial borders of said material overlap the hubs of the two reels occupying the end axial positions of said first unitary assembly;

a support member having a base panel equal in length to the axial length of said first unitary assembly, and having two spaced, upstanding end panels, each of which includes an opening generally similar in shape and diameter to said mounting opening, but being spaced from said panel by a distance greater than the radius of a reel flange; and a pair of end plugs mounted in the end panel openings of said support member, capturing said borders of said stretch-wrap material, and being mounted in the mounting openings of the reels occupying the end axial positions of said second unitary assembly, to thereby form a third unitary assembly which is substantially sealed.

2. The package of claim 1 wherein said end plugs penetrate said second unitary assembly at least to the depth of the two stacking rings occupying the end axial positions of said second unitary assembly.

3. The package of claim 2 wherein said stretch-wrap material is wound at least three times about the circumference of said first unitary assembly.

4. The package of claim 2 wherein said stretch-wrap material is a single-piece material of the defined width, and wherein said stretch-wrap material is wound at least three times about the circumference of said first unitary assembly.

5. The package of claim 3 including means to attach the leading edge of said stretch-wrap material to said first unitary assembly prior to wrapping.

6. The package of claim 4 including means to attach the leading edge of said stretch-wrap material to said first unitary assembly prior to wrapping.

7. The package of claim 5 wherein said end panels are substantially square, and including an overpack box into which said third unitary assembly is placed.

8. The package of claim 6 wherein said end panels are substantially square, and including an overpack box into which said third unitary assembly is placed.

9. A magnetic tape reel package comprising:

a first unitary assembly of N reels which are axially stacked and wrapped by a length of stretch-material, at a wrap-tension such that the border portions of said wrap material conform to the side flanges of the end reels in the stack, and extend to the centrally-disposed hub opening of these reels, said wrap material thereby exerting an axial force on said reels;

a U-shaped support member having a base panel about equal in length to the axial length of said first unitary assembly, and having a pair of panels which extend at about 90° to said base panel and are spaced apart a distance about equal to the axial length of said first unitary assembly, each of said extending panels having an opening similar to said hub opening, but spaced from said base panel by a distance greater than the radius of the reels; and a pair of mounting bosses, one of which extends through the opening in each of extending panels, so as to capture the borders of said wrap material and force the same into the hub openings of the end reels of said stack, to thereby form a sealed, second unitary assembly.

10. The package of claim 9 including a protective box surrounding said second unitary assembly.

11. The reel package of claim 10 wherein all dimensions of said extending panels, relative the position of said opening therein, is greater than the radius of the reels, and wherein said protective box conforms to the shape of said base panel and to the shape of said extending panels, to thereby ensure that the edges of said reels do not engage the inner surface of said protective box.

* * * * *